US008876589B2

(12) United States Patent
Strom

(10) Patent No.: US 8,876,589 B2
(45) Date of Patent: Nov. 4, 2014

(54) MULTI-WAGER SLOT GAMING SYSTEM

(71) Applicant: Mark Anthony Strom, Avondale (NZ)

(72) Inventor: Mark Anthony Strom, Avondale (NZ)

(73) Assignee: Native Games Entertainment International Ltd., Balmoral, Auckland (NZ)

( * ) Notice: Subject to any disclaimer, the term of this patent is extended or adjusted under 35 U.S.C. 154(b) by 46 days.

(21) Appl. No.: 13/716,938

(22) Filed: Dec. 17, 2012

(65) Prior Publication Data

US 2014/0171173 A1 Jun. 19, 2014

(51) Int. Cl.
*A63F 13/00* (2014.01)
*A63F 9/24* (2006.01)

(52) U.S. Cl.
CPC ..... *A63F 9/24* (2013.01)
USPC ..... 463/20; 463/16; 463/17; 463/18; 463/19; 463/25

(58) Field of Classification Search
CPC ... A63F 13/005; A63F 13/10; A63F 2300/64; A63F 2300/643; A63F 2001/008; A63F 2300/404; A63F 2300/408; A63F 13/12; A63F 2300/407; A63F 2300/50; G07F 17/32; G07F 17/3244; G07F 17/3267; G07F 17/3211; G07F 17/3276; G07F 17/326; G07F 17/3216; G07F 17/34; G07F 17/3227; G07F 17/3258; G07F 17/3262; G07F 17/3281; G07F 17/3204; G07F 17/323; G06Q 30/04; G06Q 30/0601; G06Q 30/0603; G06Q 30/0633; G06Q 50/34; H04L 65/4084; H04L 65/607; H04L 67/04; H04L 67/38
USPC ..... 463/16–20, 22–25
See application file for complete search history.

(56) References Cited

U.S. PATENT DOCUMENTS

| | | | | |
|---|---|---|---|---|
| 6,059,289 | A * | 5/2000 | Vancura | 273/143 R |
| 6,142,873 | A | 11/2000 | Weiss et al. | |
| 7,329,180 | B2 | 2/2008 | Strom | |
| 7,513,505 | B2 | 4/2009 | Berman et al. | |
| 7,575,513 | B2 | 8/2009 | Strom | |
| 7,591,724 | B2 | 9/2009 | Baerlocher | |
| 7,654,896 | B2 * | 2/2010 | Baerlocher | 463/16 |
| 7,753,769 | B2 | 7/2010 | Gomez et al. | |
| 7,841,936 | B2 | 11/2010 | Berman et al. | |
| 7,874,910 | B2 | 1/2011 | Berman | |
| 8,197,329 | B2 | 6/2012 | Engleman et al. | |
| 8,262,456 | B2 * | 9/2012 | Englman et al. | 463/20 |
| 2005/0043080 | A1 | 2/2005 | Strom | |
| 2006/0079318 | A1 * | 4/2006 | Aoki et al. | 463/25 |
| 2006/0189363 | A1 | 8/2006 | Strom | |
| 2006/0194629 | A1 | 8/2006 | Strom | |
| 2007/0060317 | A1 * | 3/2007 | Martin | 463/26 |

* cited by examiner

*Primary Examiner* — Sunit Pandya
(74) *Attorney, Agent, or Firm* — Mark A. Litman & Associates, P.A.

(57) ABSTRACT

A wagering game and wagering apparatus has a processor and display system. The processor recognizes two wager segments to play a single round of the wagering game. The processor credits one wager segment to a first game and the processor credits a second wager segment to a second game. The processor resolves the first wager segment with respect to the random symbols used in the first game. The processor terminating the single round of play of the wagering game by resolving no additional wagering activity if the symbols provided in the first game do not trigger a bonus event for application to the second game in the two games further resolving the bonus event applied to the second game if the symbols provided in the first game do trigger a bonus event for application to the second game.

20 Claims, 4 Drawing Sheets

MULTI-WAGER SLOT GAMING SYSTEM

BACKGROUND OF THE INVENTION

1. Field of the Invention

The present invention relates to the field of slot wagering games, such as reel gaming systems and video gaming systems. The invention further relates to the field of slot gaming systems that involve multiple games and wagers in contemporaneous play and have inter-game effects with the multiple games.

2. Background of the Art

U.S. Pat. No. 8,197,329 (Engleman) describes a gaming system for playing a wagering game comprises at least one display adapted to display a plurality of reels having symbols. The symbols indicate a randomly selected outcome of the wagering game. The plurality of reels includes at least one single-symbol reel and at least one multi-symbol reel. The at least one display is adapted to display at least one payline overlapping at least one symbol from the at least one single-symbol reel and at least one symbol from the at least one multi-symbol reel.

U.S. Pat. No. 7,874,910 (Berman) describes a method and apparatus for use in gaming activities such as slot machines. Multiple display segments are presented, where one or more of the display segments are presented having multiple display subsegments. Display subsegments present subsegment symbols independently of the other display subsegments in its respective display segment. Paylines are created from a plurality of the display segments, where the subsegment symbols of the display subsegments are independently used in formulating payout results for paylines in which the display segment is affiliated. Paylines may be dynamically created at any location as a result of corresponding symbols occurring in a predetermined number of adjacent U.S. Pat. No. 7,841,936 (Berman) describes a system and method for facilitating participation by a player in a primary or bonus event of a slot machine. A plurality of rotatable shapes such as wheels, with symbols presented thereon, are spun. Each of the rotatable shapes is associated with at least one respective segment designator to identify at least one of the symbols on that rotatable shape as active for that spin. Each rotatable shape is allowed to perform subsequent spins if the segment designator for that shape on the current spin did not identify a discontinue symbol. Spins therefore continue for each of the rotatable shapes until all rotatable shapes have been associated with a discontinue symbol, or another termination event occurs. Payouts may be associated with some or all of the continue symbols, such that a total payout continues to accumulate at the rotatable shapes are allowed to perform additional spins. display segments and/or subsegments.

U.S. Pat. No. 7,753,769 (Gomez) describes a gaming terminal that is utilized for playing a wagering game. A wager-input device receives a wager from a player. A display displays symbols indicating a randomly selected outcome selected from a plurality of outcomes. The plurality of outcomes include at least one special-event outcome that awards additional game play at a time selectable by the player. The additional game play provides a guaranteed winning outcome. A special-event input device initiates the additional game play in response to the player activating the special-event input device. The additional game play is implemented with a game-enhancement parameter such that the guaranteed winning outcome has an enhanced payout.

U.S. Pat. No. 7,591,724 (Baerlocher) describes a gaming device in which primary game symbols are generated in association with secondary symbols. The secondary symbols if generated in a particular combination and in a particular situation, e.g., in association with winning base game symbols, provide a benefit to the player, such as a modification of a payout provided from the base or primary game win. In one embodiment, multiple secondary symbols appearing on slot machine reels are evaluated for a win. In another embodiment, a match between a secondary symbol appearing on slot machine reel and a secondary symbol appearing on a separate secondary reel yields a win. In a third embodiment, a winning combination of at least one secondary symbol appearing on slot machine reel in combination with a secondary symbol appearing on a separate secondary reel yields a win.

U.S. Pat. No. 7,513,505 (Berman) describes a system for presenting payouts in gaming activities. The invention may be used in connection with primary gaming activity and/or in connection with secondary/bonus activity. The invention provides a controllable selection and/or item capture mechanism used to identify full or partial payout values, and/or other play parameters such as multipliers, continue/discontinue identifiers, etc. The system and/or the user can control the selection/capture mechanism. In one embodiment, a platform typically concealed from the participant is moved to a location proximate the item capture mechanism, and a particular selectable item determined by the RNG is retrieved by the item capture mechanism among the otherwise perceivable selectable items.

U.S. Pat. No. 7,329,180 (Strom) describes a reel-type display wagering game is provided in which the symbols on the frames or positions of the pay line display are capable of having an ordered arrangement of separately provided and separately determined generic symbols and species symbols. The generic symbols may be provided in a number of ways. The generic symbols may be provided in a separate set of reels or frames, or may be added as subtext or supertext on the same frame or reel position as the species symbols.

U.S. Pat. No. 7,575,513 (Strom) describes a method of playing a video wagering game and a video apparatus for that method. The method may include a player placing a wager in a wagering machine having a processor; the wagering machine displaying at least a single payline of multiple frames influenced by at least two distinct indicators; the processor determining from one displayed distinct indicator on the payline whether the symbols provide at least one of at least two available different odds on the wager that are associated with an award; providing a second set of indicators associated with the payline, individual members of the second set of indicators associated with individual frames wherein predetermined combinations and/or orders of the second set of indicators are winning combinations and/or orders based on the wager; and providing the player with at least one award providing a specific multiple of at least some awards based upon the second set of indicators displayed on the payline.

Published US Patent Application Documents 2005/0043080; 2006/0189363; and 2006/0194629 (Strom) also describe video and reel gaming systems in which symbols from separate spins are combined to form predetermined combinations of symbols and sub-symbols within frames or affecting specific frames to determine outcomes and enhanced payouts.

U.S. Pat. No. 6,142,873 (Weiss) describes a gaming device and method which provides a player with an opportunity of an enhanced output based on a display of a first predetermined value on a first display which subsequently activates a second display controllable to a certain extent by the player. The second display provides the player with an enhanced credit scheme and provides the player with a second option of continuing to attempt to enhance the credit payout or retiring before an event occurs which extinguishes the bonusing feature and the award.

All reference cited herein are incorporated by references in their entirety.

SUMMARY OF THE INVENTION

A wagering game and wagering apparatus has a processor and display system. The processor recognizes two wager segments to play a single round of the wagering game. The processor credits one wager segment to a first game and the processor credits a second wager segment to a second game. The processor resolves the first wager segment with respect to the random symbols used in the first game. The processor terminating the single round of play of the wagering game by resolving no additional wagering activity if the symbols provided in the first game do not trigger a bonus event for application to the second game in the two games further resolving the bonus event applied to the second game if the symbols provided in the first game do trigger a bonus event for application to the second game.

DETAILED DESCRIPTION OF THE INVENTION

Figure 1:
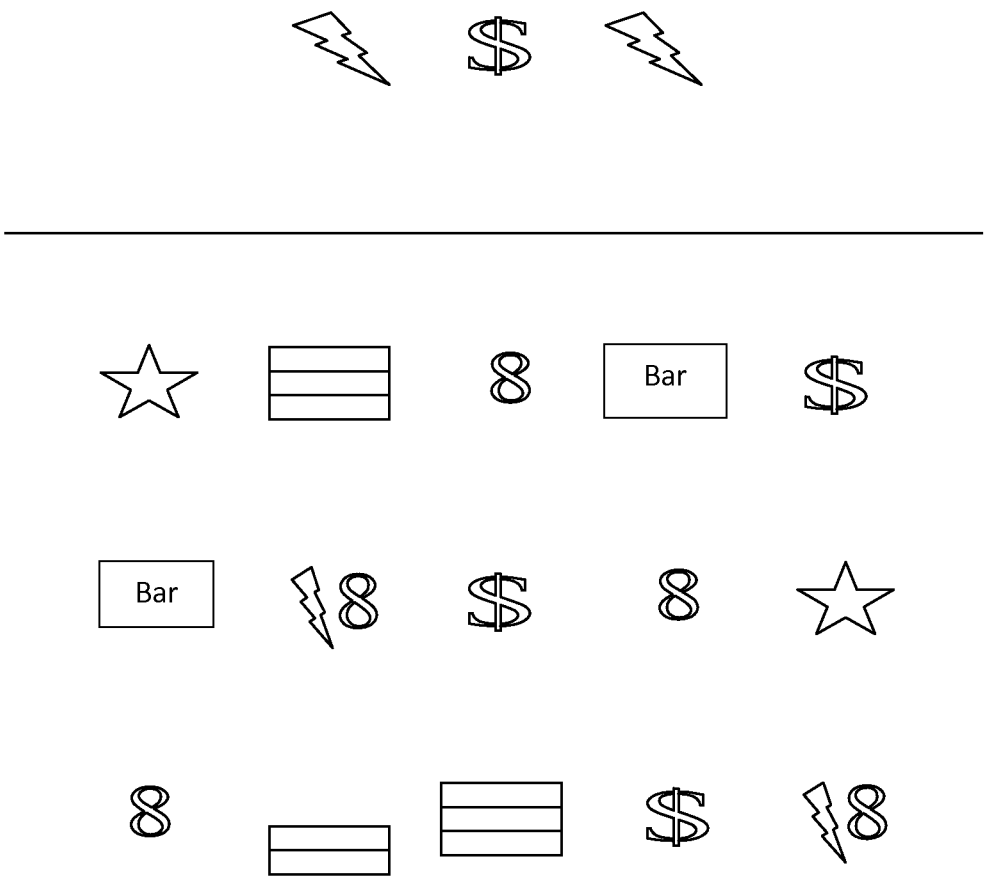
FIG. 1 shows two sets of adjacent reels that may be used to effect one embodiment of play within the present generic invention.

It will be readily apparent to one of ordinary skill in the art that the various processes described herein may be implemented by, e.g., appropriately programmed general purpose computers, special purpose computers and computing devices. Typically a processor (e.g., one or more microprocessors, one or more microcontrollers, one or more digital signal processors) will receive instructions (e.g., from a memory or like device), and execute those instructions, thereby performing one or more processes defined by those instructions. Instructions may be embodied in, e.g., one or more computer programs, one or more scripts.

A "processor" means one or more microprocessors, central processing units (CPUs), computing devices, microcontrollers, digital signal processors, or like devices or any combination thereof, regardless of the architecture (e.g., chip-level multiprocessing/multi-core, RISC, CISC, Microprocessor without Interlocked Pipeline Stages, pipelining configuration, simultaneous multithreading).

Thus a description of a process is likewise a description of an apparatus for performing the process. The apparatus that performs the process can include, e.g., a processor and those input devices and output devices that are appropriate to perform the process.

Further, programs that implement such methods (as well as other types of data) may be stored and transmitted using a variety of media (e.g., computer readable media) in a number of manners. In some embodiments, hard-wired circuitry or custom hardware may be used in place of, or in combination with, some or all of the software instructions that can implement the processes of various embodiments. Thus, various combinations of hardware and software may be used instead of software only.

The term "computer-readable medium" refers to any medium, a plurality of the same, or a combination of different media, that participate in providing data (e.g., instructions, data structures) which may be read by a computer, a processor or a like device. Such a medium may take many forms, including but not limited to, non-volatile media, volatile media, and transmission media. Non-volatile media include, for example, optical or magnetic disks and other persistent memory. Volatile media include dynamic random access memory (DRAM), which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying data (e.g. sequences of instructions) to a processor. For example, data may be (i) delivered from RAM to a processor; (ii) carried over a wireless transmission medium; (iii) formatted and/or transmitted according to numerous formats, standards or protocols, such as Ethernet (or IEEE 802.3), SAP, ATP, Bluetooth™, and TCP/IP, TDMA, CDMA, and 3G; and/or (iv) encrypted to ensure privacy or prevent fraud in any of a variety of ways well known in the art.

Thus a description of a process is likewise a description of a computer-readable medium storing a program for performing the process. The computer-readable medium can store (in any appropriate format) those program elements which are appropriate to perform the method.

Just as the description of various steps in a process does not indicate that all the described steps are required, embodiments of an apparatus include a computer/computing device operable to perform some (but not necessarily all) of the described process.

Likewise, just as the description of various steps in a process does not indicate that all the described steps are required, embodiments of a computer-readable medium storing a program or data structure include a computer-readable medium storing a program that, when executed, can cause a processor to perform some (but not necessarily all) of the described process.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models and/or distributed databases) could be used to store and manipulate the data types described herein. Likewise, object methods or behaviors of a database can be used to implement various processes, such as the described herein. In addition, the databases may, in a known manner, be stored locally or remotely from a device which accesses data in such a database.

Various embodiments can be configured to work in a network environment including a computer that is in communication (e.g., via a communications network) with one or more devices. The computer may communicate with the devices directly or indirectly, via any wired or wireless medium (e.g. the Internet, LAN, WAN or Ethernet, Token Ring, a telephone line, a cable line, a radio channel, an optical communications line, commercial on-line service providers, bulletin board systems, a satellite communications link, a combination of any of the above). Each of the devices may themselves comprise computers or other computing devices, such as those based on the Intel® Pentium® or Centrino™ processor, that are adapted to communicate with the computer. Any number and type of devices may be in communication with the computer. On-line gaming technology that can support this game is enabled through Published U.S. Patent Applications Nos. 20120212484; 20120194551; 20120184361; 20120106326; 20120079091; 20120046101; 20110306395; 20110294569; 20110294561; 20110154447; 20110116461; 20110047267 and the like.

In some embodiments, a server computer and one or more client computers may perform desired actions. Actions may be performed by one or more of the clients and/or servers in accordance with a desired distribution of labor. Such distribution of labor may be made based on where the actions may be performed more securely, more quickly, and/or more cost-effectively. For example, in some implementations, complex calculations may be performed by a central server to increase speed, display related calculations may be performed by a client because they may be simple, outcome determining calculations may be performed by a central server in order to ensure the validity of the calculations and allow tweaking of odds to be performed at a single location. It should be recognized that any desired actions may be divided among a server and any number of clients in any desired way.

In an embodiment, a server computer or centralized authority may not be necessary or desirable. For example, the present invention may, in an embodiment, be practiced on one or more devices without a central authority. In such an embodiment, any functions described herein as performed by the server computer or data described as stored on the server computer may instead be performed by or stored on one or more such devices.

Where a process is described, in an embodiment the process may operate without any user intervention. In another embodiment, the process includes some human intervention (e.g., a step is performed by or with the assistance of a human).

Figure 1A:
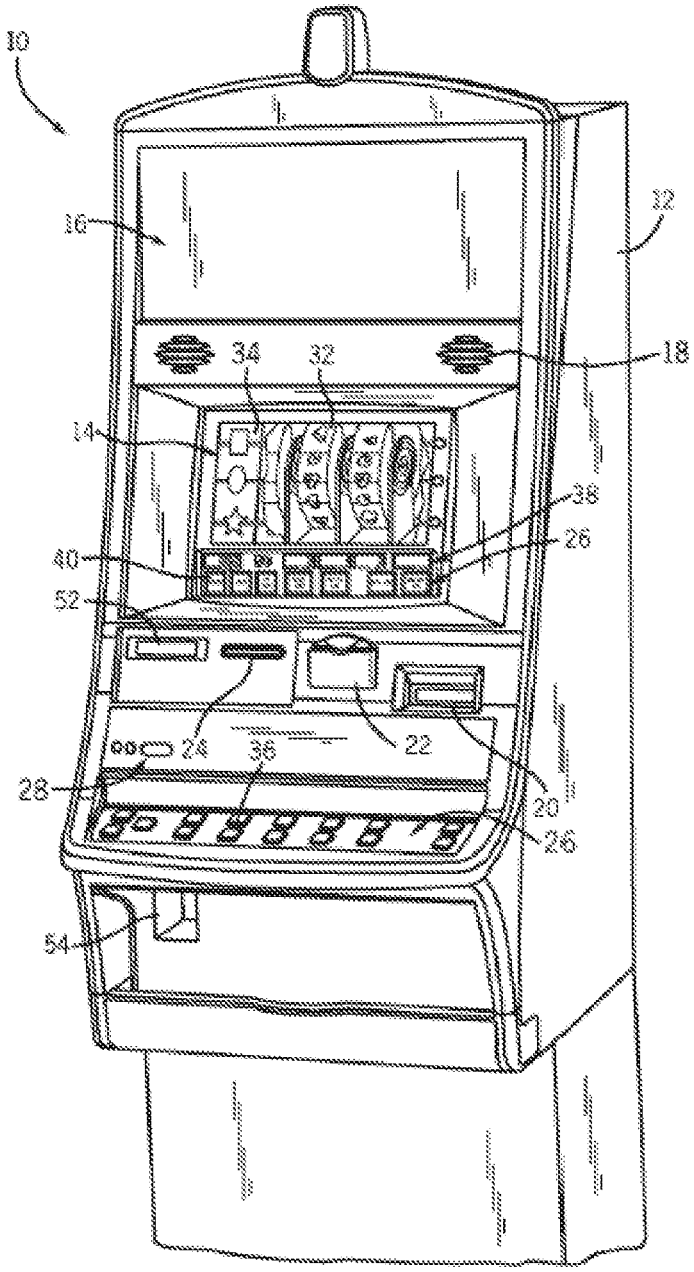
FIG. 1A is a perspective view of a free standing gaming machine embodying the present invention.

Referring to FIG. 1A, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

Among the technologies within the generic scope of invention enables herein is included a method of playing a wagering game on wagering apparatus, where the wagering apparatus comprises a processor, a display system (either mechanical, electromechanical or electronic is included within the term) for individual (each frame in a video display or at each intersection of a column and row) and collective symbol output (paylines as defined within the industry, including non-linear paylines and scatter-pay symbol combination), and an input system for wagering on the wagering game, wherein the method comprises:

a) the processor recognizing two wager segments (as explained in greater detail later, either exactly two or more wagers of equal or unequal amounts or number of credits or a single wager parsed by the processor) to play a single round of the wagering game;

b) the processor crediting one wager segment to a first distinct display segment used in the play of a first game and the processor crediting a second wager segment to a second distinct display segment used in the play of a second game;

c) the processor initiating game play and providing random symbols from a first set of symbols to the first display segment for use in the first game. In a mechanical reel, the individual frames are typically mapped individually or by templates and randomly selected by operation of a random number generator, and in a video system the frames are filled by random symbol selection by a random number generator, the frames again being mapped or weighted as is known in the art;

d) the processor providing random symbols from a second set of symbols to the second display segment for use in the second game. The sets of symbols may be similar, the same or different, and weighting or mapping may be the same or different, and the numbers of frames, paylines and the like may be the same or different in the two underlying games;

e) the processor resolving the first wager segment with respect to the random symbols used in the first game;

f) the processor resolving the second wager segment with respect to the random symbols used in the second game;

g) the processor determining if symbols provided in the first game trigger a bonus event for application to the second game. The trigger may be a particular symbol combination used in the first game (e.g., three 7's of the same color) or may be symbol(s) unique to the bonus event (e.g., lightning bolts, character faces, etc.)); and h) the processor terminating the single round of play of the wagering game by i) resolving no additional wagering activity if the symbols provided in the first game do not trigger a bonus event for application to the second game in g) and ii) further resolving the bonus event applied to the second game if the symbols provided in the first game do trigger a bonus event for application to the second game in g).

Subsequent rounds of play may then be engaged by repeating the steps of the process. The two wager segments may be identified by the processor as two wager segments selected from the group consisting of iii) two distinct wager amounts identified by the processor from input signals from the input system for wagering on the wagering game and iv) a single wager amount that the processor allots as the two separate wagers between the first game segment and the second game segment. The display system for individual and collective symbol output is selected from the group consisting of v) a physical reel system providing the first and second distinct display segments controlled by the processor, vi) a video display system providing the first and second distinct display segments controlled by the processor and a combination of a physical reel system and vii) a video display system providing the first and second distinct display segments controlled by the processor. The first display segment may consist of a first set of at least 3-5 symbols and the second display segment consists of at least 3-5 symbols or the first display segment consists of a first set of at exactly 3-5 symbols and the second display segment consists of exactly 3-5 symbols. Multiple lines (e.g., a separate 3×5 or 5×5 display, or more) may be used in the second game or the first game, with additional paylines usually engaged by additional wagers on the particular game and lines to be active in play. One or more symbols within a set of a single specific symbol provided in the first game may be recognized by the processor as the single specific symbol effecting a bonus event for application to the second game.

In the method, a portion of at least one of the two wager segments may be transferred into a jackpot and increased amounts of at least one of the first wager segment and the second wager segment increase amounts provided in the resolution of the bonus event in h) ii).

An example of a gaming apparatus within the scope of the present generic invention may include a processor, a display system for individual and collective symbol output, and an input system for wagering on the wagering game, wherein the processor is configured to execute code to effect a game method that includes:

a) the processor recognizing two wager segments to play a single round of the wagering game;
b) the processor crediting one wager segment to a first distinct display segment used in the play of a first game and the processor crediting a second wager segment to a second distinct display segment used in the play of a second game;
c) the processor initiating game play and providing random symbols from a first set of symbols to the first display segment for use in the first game;
d) the processor providing random symbols from a second set of symbols to the second display segment for use in the second game;
e) the processor resolving the first wager segment with respect to the random symbols used in the first game;
f) the processor resolving the second wager segment with respect to the random symbols used in the second game;
g) the processor determining if symbols provided in the first game trigger a bonus event for application to the second game; and
h) the processor terminating the single round of play of the wagering game by i) resolving no additional wagering activity if the symbols provided in the first game do not trigger a bonus event for application to the second game in g) and ii) further resolving the bonus event applied to the second game if the symbols provided in the first game do trigger a bonus event for application to the second game in g).

The gaming apparatus may have the two wager segments identified by the processor as two wager segments selected from the group consisting of iii) two distinct wager amounts identified by the processor from input signals from the input system for wagering on the wagering game and iv) a single wager amount that the processor allots as the two separate wagers between the first game segment and the second game segment. The gaming apparatus may have the display system for individual and collective symbol output as selected from the group consisting of v) a physical reel system providing the first and second distinct display segments controlled by the processor, vi) a video display system providing the first and second distinct display segments controlled by the processor and a combination of a physical reel system and vii) a video display system providing the first and second distinct display segments controlled by the processor.

An alternative way of describing a method of playing a game on an electronic gaming system according to the generic practices of the invention may be where the electronic gaming system includes:

A) a processor;
B) a display system;
C) data entry systems in communication with the processor;
D) an electronic random number generator in communication with the central processor; and
E) memory containing look-up tables of event result tables;

and the method comprising the steps of:

a) the processor recognizing two wager segments to play a single round of the wagering game;
b) the processor crediting one wager segment to a first distinct display segment used in the play of a first game and the processor crediting a second wager segment to a second distinct display segment used in the play of a second game;
c) the processor initiating game play and providing random symbols from a first set of symbols to the first display segment for use in the first game;
d) the processor providing random symbols from a second set of symbols to the second display segment for use in the second game;
e) the processor resolving the first wager segment with respect to the random symbols used in the first game;
f) the processor resolving the second wager segment with respect to the random symbols used in the second game;
g) the processor determining if symbols provided in the first game trigger a bonus event for application to the second game; and
h) the processor terminating the single round of play of the wagering game by i) resolving no additional wagering activity if the symbols provided in the first game do not trigger a bonus event for application to the second game in g) and ii) further resolving the bonus event applied to the second game if the symbols provided in the first game do trigger a bonus event for application to the second game in g).

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
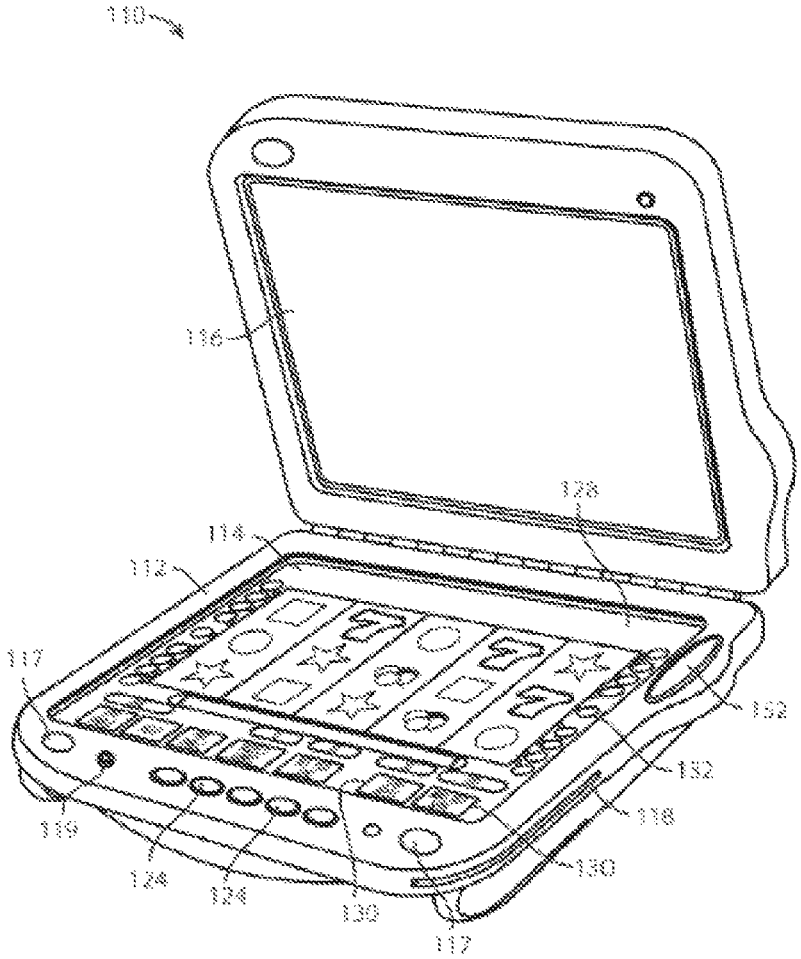
FIG. 1B is a perspective view of a handheld gaming machine embodying the present invention.

Depicted in FIG. 1B is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1B, comprises a biometric sensing device.

Figure 2:
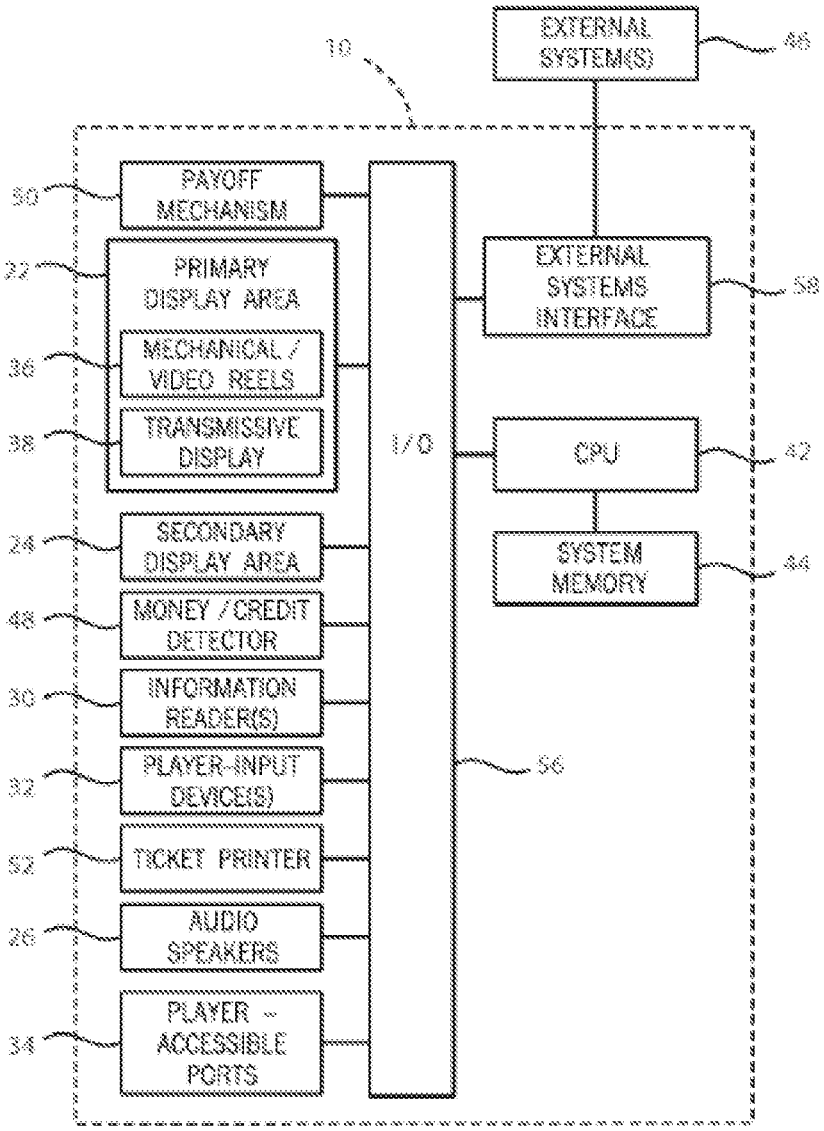
FIG. 2 is a block diagram of a control system suitable for operating the gaming machines of FIGS. 1A and 1B.

Turning now to FIG. 2, the various components of the gaming machine 10 are controlled by a central processing unit (CPU) 42, also referred to herein as a controller or processor (such as a microcontroller or microprocessor). To provide gaming functions, the controller 42 executes one or more game programs stored in a computer readable storage medium, in the form of memory 36. The controller 42 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 42 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 44 may include multiple RAM and multiple program memories. The money/credit detector 48 signals the processor that money and/or credits have been input via the value input device (not shown). Preferably, these components are located within the housing 12 of the gaming machine 10.

However, as explained above, these components may be located outboard of the housing 12 and connected to the remainder of the components of the gaming machine 10 via a variety of different wired or wireless connection methods.

As seen in FIG. 2, the controller CPU 42 is also connected to, and controls, the primary display 22, the player input device 32, and a payoff mechanism 50. The payoff mechanism 50 is operable in response to instructions from the controller 42 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 50 includes both a ticket printer 52 and a coin outlet (not shown). However, any of a variety of payoff mechanisms 50 well known in the art may be implemented, including cards, coins, tickets, smartcards, cash, etc. The payoff amounts distributed by the payoff mechanism 40 are determined by one or more pay tables stored in the system memory 44.

Communications between the controller 42 and both the peripheral components of the gaming machine 10 and external systems 46 occur through input/output (I/O) circuits 34, 56. More specifically, the controller 34 controls and receives inputs from the peripheral components of the gaming machine 10 through the input/output circuits 46. Further, the controller 34 communicates with the external systems 46 via the I/O circuits 34 or the external; systems interface 58 and a communication path (e.g., serial, parallel, IR, RC, 10 bT, etc.). The external systems 46 may include a gaming network, other gaming machines, a gaming server, communications hardware, or a variety of other interfaced systems or components. Although the I/O circuits 34 may be shown as a single block, it should be appreciated that each of the I/O circuits 34 may include a number of different types of I/O circuits.

Controller, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller in the gaming machine 10 is depicted as comprising a CPU, but the controller 34 may alternatively comprise a CPU in combination with other components, such as the I/O circuits 34, 56 and the system memory 44. The controller may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 42 on board the gaming machine processes display information to be displayed on the display(s) of the machine. In an alternative "rich client" configuration, the server determines game outcomes, while the controller 42 on board the gaming machine executes game code and processes display information to be displayed on the display(s) of the machines. In yet another alternative "thick client" configuration, the controller 42 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

In one embodiment, the gaming device preferably includes at least one processor, such as a microprocessor, a microcontroller-based platform, a suitable integrated circuit or one or more application-specific integrated circuits (ASIC's). The processor is in communication with or operable to access or to exchange signals with at least one data storage or memory device. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The upper display device may display the primary game, any suitable secondary game associated or not associated with the primary game and/or information relating to the primary or secondary game. These display devices may also serve as digital glass operable to advertise games or other aspects of the gaming establishment. As seen in FIG. 1A, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, the display device includes a touch-screen with an associated touch-screen controller. The display devices may be of any suitable size and configuration, such as a square, a rectangle or an elongated rectangle.

The game format described herein shall be referred to as 2-Coin Wagering or 2CW or TCW.

2-Coin/Credit Incremented Wagers—(2CW)

Description:

'2CW' is a compulsory wagering option that requires increments of 2 coin/credits per wager. For example, if a slot games denomination is '1 cent with a maximum coin-in of 60 coins (60 c)', then the new proposed method would change that when applying 2CW leaving it the same in denomination (1 c) but requiring 2 c (minimum) increments and doubling every coin wagered where maximum coin-in is now 120 coins-in ($1.20). A $5 game would become a $10 game and a $100 game would become a $200 game etc.

As a result of the aforementioned and to justify the need to compulsorily wager 2 coins as opposed to 1, a second set of pay-tables is produced duplicating the awards on offer and increasing the odds on those same awards as demonstrated in the table below.

| | | | | |
|---|---|---|---|---|
| 3-Bars | 5 | 300 | 600 | 1800 |
| | 4 | 150 | 300 | 900 |
| | 3 | 30 | 60 | 180 |
| 2-bars | 5 | 200 | 400 | 1200 |
| | 4 | 100 | 200 | 600 |
| | 3 | 20 | 40 | 120 |
| 1-Bar | 5 | 100 | 200 | 600 |
| | 4 | 50 | 100 | 300 |
| | 3 | 10 | 20 | 60 |
| Any Bar | 5 | 30 | 60 | 180 |
| | 4 | 10 | 20 | 60 |
| | 3 | 5 | 10 | 30 |
| Dollar | 5 | 100 | 200 | 600 |
| | 4 | 50 | 100 | 300 |
| | 3 | 20 | 40 | 120 |
| Star | 5 | 75 | 150 | 450 |
| | 4 | 25 | 50 | 150 |
| | 3 | 10 | 20 | 60 |
| Bonus | 3 | 20 | — | ×6 |
| Bolt | 2 | 5 | ×2 | — |

In addition to that justification a bonus (bonus bolt, a game in itself) award is created so that the $1^{st}$ coin wagered can pay when the $2^{nd}$ coin wagered does not or vice-versa. The effect of both coins winning is the payouts indicated in the additional paytables.

The hit frequency of any game is increased where '2CW' is applied. For example, $1^{st}$ coin wins has a hit frequency of 10% (1 in 10) and $2^{nd}$ coin wins has a hit frequency of 10% (1 in 10) therefore theoretically, the hit frequency of winning at least on one of the coins is 20% (1 in 5).

Coin-Based Awards Table

The following tables show the distribution of odds and payouts depending upon coins/value wagered on each round of play.

1st 2 Credits Per Line

| | | | | |
|---|---|---|---|---|
| 3-Bars | 5 | 300 | 600 | 1800 |
| | 4 | 150 | 300 | 900 |
| | 3 | 30 | 60 | 180 |

-continued

| | | | | |
|---|---|---|---|---|
| 2-bars | 5 | 200 | 400 | 1200 |
| | 4 | 100 | 200 | 600 |
| | 3 | 20 | 40 | 120 |
| 1-Bar | 5 | 100 | 200 | 600 |
| | 4 | 50 | 100 | 300 |
| | 3 | 10 | 20 | 60 |
| Any Bar | 5 | 30 | 60 | 180 |
| | 4 | 10 | 20 | 60 |
| | 3 | 5 | 10 | 30 |
| Dollar | 5 | 100 | 200 | 600 |
| | 4 | 50 | 100 | 300 |
| | 3 | 20 | 40 | 120 |
| Star | 5 | 75 | 150 | 450 |
| | 4 | 25 | 50 | 150 |
| | 3 | 10 | 20 | 60 |
| Bonus | 3 | 20 | — | ×6 |
| Bolt | 2 | 5 | ×2 | — |

$2^{nd}$ 2 Credits Per Line

| | | | | |
|---|---|---|---|---|
| L/Eights | 5 | 7500 | 15000 | 45000 |
| | 4 | 300 | 600 | 1800 |
| | 3 | 200 | 400 | 1200 |
| P/Eights | 5 | 500 | 1000 | 3000 |
| | 4 | 150 | 300 | 900 |
| | 3 | 80 | 160 | 480 |
| A/Eights | 5 | 200 | 400 | 1200 |
| | 4 | 50 | 100 | 300 |
| | 3 | 25 | 50 | 150 |
| Bonus | 3 | 40 | — | ×6 |
| Bolt | 2 | 10 | ×2 | — |

$3^{rd}$ 2 Credits Per Line

| | | | | |
|---|---|---|---|---|
| L/Eights | 5 | 20000 | 40000 | 120000 |
| | 4 | 1200 | 2400 | 7200 |
| | 3 | 800 | 1600 | 4800 |
| P/Eights | 5 | 4000 | 8000 | 24000 |
| | 4 | 600 | 1200 | 3600 |
| | 3 | 300 | 600 | 1800 |
| A/Eights | 5 | 1000 | 2000 | 6000 |
| | 4 | 200 | 400 | 1200 |
| | 3 | 100 | 200 | 600 |
| Bonus | 3 | 60 | — | ×6 |
| Bolt | 2 | 15 | ×2 | — |

Current games such as Video, Slots, Tables (electronic), Scratch Tickets, Pull Tabs and even Lotteries, Bingo, Keno and Horse Racing can adopt 2-Coin wagering options.

One important aspect of some variations within the generic scope of '2CW' is the way in which it's delivered. THE FIRST COIN/CREDIT WIN PREFERABLY MUST PAY-OUT/AWARD IT'S PRIZE BEFORE THE RESULT OF THE SECOND COIN/CREDIT IS FULLY REVEALED. The system also may merely indicate "An Award" has been obtained, and conceal the amount until later. This build's anticipation of a potential 'Bigger Win' by winning the $1^{st}$ coin play and satisfaction that a win has already been achieved, but also importantly, if the $1^{st}$ coin loses there is still a $2^{nd}$ coin play to potentially win on. 2 Coin Wagering is 2 games in one!

The benefits of '2CW' are far reaching. In all forms of legalised gaming there are essentially two players, the PLAYER and the HOUSE or OPERATOR. The contradictory goal of satisfying both is the game designers challenge.

The Player:

There are many types of players but categorically they would fall in to the description of either a professional, occasional, habitual and need we say it from within these groups a small percentage become 'problem gamblers' of whom many if not all jurisdictions have introduced 'responsible gaming laws' for operators, to help deter and detect such behaviour.

Designing successful games require many considerations, but the 'players bankroll' (the amount a player starts with) is the most important information the designer has to work with. The categories of players mentioned previously is classified by how they view there 'bankroll' whether they are aware of it or not, where todays so-called 'problem gambler' usually falls in to the latter category. Today's society demands a more responsible approach to gaming in its vast array of formats available throughout the world, therefore a designer should consider this when attempting to create a game. For example, let's look at the format that 'problem gambling statistics' highlight as the worst contributor, the slot machine (no surprises). In most countries or jurisdictions where legalised gambling is permitted they have outlawed an ingredient that was employed by manufacturers in the designs of their games called 'the near miss factor'. Psychologically that caused a sense of 'just missing the big win'. This would contribute to an added sense that the 'big win' was about to come up or their luck was about to change and guess what, before they knew it their 'bankroll' runs out, resulting in that final sense that its time to leave resenting their losses while vowing to conquer it next time, not to mention what this pathological mindset leads to when families are affected by this behavior. It is difficult to find a solution to problem gambling but a game design should be mindful of the sense it will create and what senses you should tap into, to lessen the effect of 'false promise', especially to those in society who are most vulnerable. A game has a lot more behind it then just having fun and a wager.

On the other hand, the huge majority of those who prefer gaming as their form of entertainment see it as just that. Purely fun with expectation of losing their bankroll and leaving without the resentment that can lead to harmful behavior, or celebrate their win and take it home as they know that on their win/loss ratio they would be lucky to be ahead, nevertheless a less harmful experience either way.

What are players looking for?, ask the professional gambler and they will say "an edge", ask the occasional gambler and they will say "fun", ask the habitual gambler and they will say "winning", but what they all share in common is the 'thrill of the chase'. When it comes to a slot machine there are only 2 types in the marketplace and they are either a 'low hit/high pay' or 'high hit/low pay' device. How can you make a 'high hit/high pay' device? The proposed 2-coin wagering method achieves this! A high hit frequency is achieved from the '2 games in 1' event so that the odds of winning on at least one of the coins is increased. The higher odds are achieved by mathematical manipulation where for example '30% of the $1^{st}$ coin provides the bonus prizes of the first game leaving the balance of 70% to be added to the 100% of the $2^{nd}$ coin for the additional paytables featuring the higher odds (less the house or operators edge ie. 10%) in the second game where the higher awards can only be won when both coins win.

The only way most players measure games is the ability to stay on the device longer, so a high hit frequency is required but they also want the attraction of high paying awards, currently with single coin play you must sacrifice one for the other. Length of play is measured by how long a bankroll (i.e., $100) lasted on a particular device, therefore 'value for money' is key in the mindset of the player which has nothing to do with winning or losing. Length of play is the 'bargain' to a player as a 'buy 1 get 1 free' offer in a retail store is to a shopper. Player satisfaction is a better goal than player perception as some popular games that are perceived to be good are mathematically flawed or biased towards the house, which are exposed by those who measure 'length of play' or 'time on device'. To sum the 'player' up they require 2 ingredients, attractive odds and time on device which equals satisfaction. The proposed 2-coin wagering method meets this criteria but, 'time on device' is a fine balancing act as you don't want the player on the device for an excessive amount of time without winning anything either. The luxury of the 2 coin method allows for manipulation of the odds and the hit frequencies affording safer and better control of the only 2 important aspects of a gaming device.

The House/Operator:

The worldwide gaming industry is always in need of new content as the demand for the next best thing is and always will be constant. Technology keeps advancing and the gaming devices of today are far more advanced than their predecessors of 50 years ago. Popular card (i.e., Poker), dice (i.e., Craps) and wheel (i.e., Roulette) table games have been around forever and will probably stay that way, but even for them technology is opening up possibilities with successful variations like Triple Play Video Poker, Electronic Roulette etc., in fact some 'casinos' in Europe are fully automated without need for dealers and croupiers. There's the Internet and more recently Mobile Devices, where the technology is moving fast and lawmakers are struggling to construct regulations to protect themselves and their citizens from foreign on-line predators (highlighted by the closure of high profile offshore on-line gaming operators taking wagers from US citizens).

The worldwide gaming industry continues to grow as more governments and jurisdictions become reliant on gaming related tax revenue and license fees. It is no secret that gaming is a multi billion dollar industry but the employment it creates and contribution to a governments annual budget justify its existence and the majority of today's society agree that it is one of the adult world's most popular forms of entertainment, supported by one thing only, 'PLAYER LOSSES', hence the importance of the player and the introduction of 'responsible gaming laws'. Some jurisdictions even ban smoking in casinos and racetracks which resulted in a downturn for a while. A lot of players now enjoy playing in smoke-free environments, but all these changes have come at a cost which operators are legally required to comply with or close down.

The House/Operator must be legally operating by holding a license with the local jurisdiction which regulates and controls the industry for the protection of all its participants. Today's laws also require the house to operate responsibly due to the 'problem gambling' issue and all game content and its math is carefully scrutinized before it is independently certified to operate in a licensed gaming venue.

The house's constant need for new content is due to the fact that players want to see new games coming out every year so most casinos will replace about 15% of their floor annually. This demand forced the introduction of branded themes as content was lacking but the shelf-life of most of these don't last long especially where a celebrity is concerned then on the other hand popular TV game shows have been a hit (i.e., Wheel of Fortune™ game).

The proposed invention of '2 coin incremented wagering' will provide the 'house' with the most important thing, the creation of a whole new way to construct games to meet the ferocious appetite of the player but even more importantly they get their edge on 2 coins instead of 1 (ie. If the theoretical house percentage on a game is 10% currently, then by applying the '2 coin incremented wager' the house will get 10% on both coins).

SUMMARY

'2 coin incremented wagering' is a new way to construct a game providing the designers with the ability to better manipulate the 'Hit Frequency' and the 'Awards' as opposed to sacrificing one for the other as is the requirement of a single coin wager. The following is from a new video poker game called 'Royal Spoil' which has been created;

The Benefits of Royal Spoil Poker

This game is included within the disclosure of Published US Patent Application Documents 2005/0043080; 2006/0189363; and 2006/0194629, cited and incorporated by references above.

Royal Spoil Poker (RSP) affords the player a sense of more control over their hands by separating suits from ranks. The player can discard and draw suits and ranks separately.

It's more fun to play. There will be no lament on a straight having all but one card suited, as 4-card suited straights are winners in RSP.

Hit frequency is higher. While most video poker games have a hit frequency of about 45%, RSP has a hit frequency of 63.2%. This resembles today's multi-line slots: You almost always win something.

A 5-card flush is a guaranteed winner no matter what the final rank is.

It's more profitable for the casinos. While the 9/6 Jacks or Better returns 99.5% on one bet, with the same return percentage RSP can earn twice for the casino because the house edge works on 2 bets. While the good perception of a high 99.5% return remains, the casino's profit in $ doubles.

Payback percentages are adjustable between the suit bet and rank bet. Where there are more slot type players, more equity can be assigned from the rank bet to the no-skill suit bet to draw those players.

Frequent High payouts are what distinguishes RSP from 9/6 Jacks or Better (9/6 JoB). Relatively speaking, RSP players can hit many more premium hands in a short run, as evidenced by the following hit frequencies categorized by the payoff odds:

| Payoff Odds per 1 Coin | RSP | 9/6 JoB | Ratio (RSP vs. 9/6 JoB) |
|---|---|---|---|
| 700 or more | 0.016% | 0.0025% | 6.4 to 1 |
| 250 or more | 0.023% | 0.0025% | 92 to 1 |
| 50 or more | 0.25% | 0.013% | 19 to 1 |
| 25 or more | 0.46% | 0.25% | 1.8 to 1 |
| 7 or more | 2.56% | 1.15% | 2.2 to 1 |

Royal flushes are more quickly attainable in RSP:

Conventional video poker will see a royal flush about once every 40,000 hands, which translates to about 80 hours of play. In RSP, it occurs just once every 6,240 hands, which translates to about 14 hours of play.

One can hit any straight flush about once every 7500 hands in 9/6 JoB and get paid 50 or 800 for 1. In RSP you can win 50 up to 700 for 1 only once every 345 hands.

There is no doubt that RSP is more exciting to play—its frequent high payouts speak for itself.

Game Pace

We understand that drawing suits and ranks separately slows the game down, so we have minimized the slowness with the following improvements:

1) Strategies are simple and intuitive.
   a) For the suit draw: Always keep the most suit.
   b) For the rank draw, it is simpler and more intuitive than Jacks or Better: Since a pair of tens—one of the 5 cards required to form a royal flush—is a winner in RSP, tens are almost always held. Also, since whether or not the hand can be suited has already been determined, one need not think about whether one should go for a flush over a pair or a straight draw.
   Also, simple and intuitive strategies mitigate frustrations and disappointment.
2) One click holds all: As soon as a suit is clicked all other cards in the same suit are automatically held.
3) The delay between the final suit draw and the deal of the ranks is opportune.

As a result, one can play about 450~480 hands an hour. Keep in mind that even though RSP is slightly slower, the casino's edge works on 2 bets.

Trustworthiness Earns Business

Even though RSP isn't entirely conventional video poker, no mystery black boxes or bonus rounds exist that can cast any doubts in the minds of hard core video poker players, experts or game analysts. The deck compositions for both the suit and rank bets will be public information, thereby enabling their paybacks to be calculated. This is important in order to earn their trust.

Another variation on the electronic gaming system may include a method of playing a wagering game on an electronic gaming system, the electronic gaming system having at least:

A) a central processor;
B) a video display system;
C) data entry systems in communication with the central processor;
D) an electronic random number generator in communication with the central processor; and
E) memory containing look-up tables of event result tables;

the method having at least steps of:

A virtual game field surface may be displayed on the video display system and is used to display movement of the two sets of reels associated to the individual first reel result by a random outcome on the second reel result according to rules of play of the game stored in the memory. The virtual game viewing surface may have markings and words relating the wagering game to a sporting event or particular theme, such as horse racing, car racing, sports events, pageants, television show themes, movie character themes, literary themes and the like.

The sporting event may, for example, be selected from the group consisting of soccer, American Football, ice hockey, NASCAR™ racing, horse racing and field hockey and communications among at least some of:

A) the central processor;
B) the video display system;
C) the data entry systems in communication with the central processor;
D) the electronic random number generator in communication with the central processor; and
E) the memory containing look-up tables of event result tables;

are transmitted by communication systems selected from the group consisting of wireless transmissions, internet transmissions, hard wired transmissions, transmissions originating from a hand-held communications device, transmissions originating from a laptop processor, transmissions originating from a floor model processor and transmissions originating from a terminal in a casino.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

What is claimed:

1. A method of playing a wagering game on a single wagering apparatus, where the single wagering apparatus comprises a first processor, a display system for individual and collective symbol output, and an input system for wagering on the wagering game, wherein the method comprises: a) the first processor recognizing two wager segments to play a single round of the wagering game; b) the processor crediting one wager segment to a first distinct display segment used in the play of a first game and the first processor crediting a second wager segment to a second distinct display segment used in the play of a second game; c) the first processor initiating game play and providing random symbols from a first set of symbols to the first display segment for use in the first game; d) the first processor providing random symbols from a second set of symbols to the second display segment for use in the second game; e) the first processor resolving the first wager segment with respect to the random symbols used in the first game; f) the first processor resolving the second wager segment with respect to the random symbols used in the second game; g) the first processor determining if symbols provided in the first game trigger a bonus event for application to the second game; and h) the first processor terminating the single round of play of the wagering game by i) resolving no additional wagering activity if the symbols provided in the first game do not trigger a bonus event for application to the second game in g) and ii) further resolving the bonus event applied to the second game if the symbols provided in the first game do trigger a bonus event for application to the second game in g).

2. The method of claim 1 wherein the two wager segments are identified by the first processor as two wager segments selected from the group consisting of iii) two distinct wager amounts identified by the first processor from input signals from the input system for wagering on the wagering game and iv) a single wager amount that the first processor allots as the two separate wagers between the first game segment and the second game segment.

3. The method of claim 1 wherein the display system for individual and collective symbol output is selected from the group consisting of v) a physical reel system providing the first and second distinct display segments controlled by the processor, vi) a video display system providing the first and second distinct display segments controlled by the processor and a combination of a physical reel system and vii) a video display system providing the first and second distinct display segments controlled by the first processor.

4. The method of claim 2 wherein the display system for individual and collective symbol output is selected from the group consisting of v) a physical reel system providing the first and second distinct display segments controlled by the first processor, vi) a video display system providing the first and second distinct display segments controlled by the processor and a combination of a physical reel system and vii) a video display system providing the first and second distinct display segments controlled by the first processor.

5. The method of claim 3 wherein the first display segment consists of a first set of at least 3 symbols and the second display segment consists of at least 3 symbols.

6. The method of claim 4 wherein the first display segment consists of a first set of at least 5 symbols and the second display segment consists of at least 5 symbols.

7. The method of claim 3 wherein the first display segment consists of a first set of at exactly 5 symbols and the second display segment consists of exactly 5 symbols.

8. The method of claim 4 wherein the first display segment consists of a first set of at exactly 3 symbols and the second display segment consists of exactly 3 symbols.

9. The method of claim 3 wherein one or more symbols within a set of a single specific symbol provided in the first game are recognized by the first processor as the single specific symbol effecting a bonus event for application to the second game.

10. The method of claim 4 wherein a portion of at least one of the two wager segments is transferred into a jackpot and increased amounts of at least one of the first wager segment and the second wager segment increase amounts provided in the resolution of the bonus event in h) ii).

11. A single gaming apparatus comprising a first processor, a single display system for individual and collective symbol output, and an input system for wagering on the wagering game, wherein the first processor is configured to execute code to effect a game method that comprises: a) the first processor recognizing two wager segments to play a single round of the wagering game; b) the first processor crediting one wager segment to a first distinct display segment on the single display system used in the play of a first game and the processor crediting a second wager segment to a second distinct display segment on the single display system used in the play of a second game; c) the first processor initiating game play and providing random symbols from a first set of symbols to the first display segment of the single display system for use in the first game; d) the first processor providing random symbols from a second set of symbols to the second display segment of the single display system for use in the second game; e) the first processor resolving the first wager segment with respect to the random symbols used in the first game; f) the first processor resolving the second wager segment with respect to the random symbols used in the second game; g) the first processor determining if symbols provided in the first game trigger a bonus event for application to the second game; and h) the first processor terminating the single round of play of the wagering game by i) resolving no additional wagering activity if the symbols provided in the first game do not trigger a bonus event for application to the second game in g) and ii) further resolving the bonus event applied to the second game if the symbols provided in the first game do trigger a bonus event for application to the second game in g).

12. The gaming apparatus of claim 11 wherein the two wager segments are identified by the first processor as two wager segments selected from the group consisting of iii) two distinct wager amounts identified by the first processor from input signals from the input system for wagering on the wagering game and iv) a single wager amount that the first processor allots as the two separate wagers between the first game segment and the second game segment.

13. The gaming apparatus of claim 11 wherein the display system for individual and collective symbol output is selected from the group consisting of v) a physical reel system providing the first and second distinct display segments controlled by the processor, vi) a video display system providing the first and second distinct display segments controlled by the first processor and a combination of a physical reel system and vii) a video display system providing the first and second distinct display segments controlled by the first processor.

14. The gaming apparatus of claim 12 wherein the display system for individual and collective symbol output is selected from the group consisting of v) a physical reel system providing the first and second distinct display segments controlled by the first processor, vi) a video display system providing the first and second distinct display segments controlled by the first processor and a combination of a physical reel system and vii) a video display system providing the first and second distinct display segments controlled by the first processor.

15. The gaming apparatus of claim 11 wherein the input system for wagering on the wagering game comprises a handheld device, input tablet, cellular telephone, terminal, or second processor in communication with a gaming system processor containing a game controller.

16. The gaming of claim 15 wherein the gaming system processor is configured to manage an on-line gaming system in communication with the input wagering system.

17. A method of playing a game on a single electronic gaming system, the single electronic gaming system comprising: A) a first processor; B) a display system; C) data entry systems in communication with the first processor; D) an electronic random number generator in communication with the first processor; and E) memory containing look-up tables of event result tables; the method comprising the steps of: a) the first processor recognizing two wager segments to play a single round of the wagering game; b) the first processor crediting one wager segment to a first distinct display segment used in the play of a first game and the first processor crediting a second wager segment to a second distinct display segment used in the play of a second game; c) the first processor initiating game play and providing random symbols from a first set of symbols to the first display segment for use in the first game; d) the first processor providing random symbols from a second set of symbols to the second display segment for use in the second game; e) the first processor resolving the first wager segment with respect to the random symbols used in the first game; f) the first processor resolving the second wager segment with respect to the random symbols used in the second game; g) the first processor determining if symbols provided in the first game trigger a bonus event for application to the second game; and h) the first processor terminating the single round of play of the wagering game by i) resolving no additional wagering activity if the symbols provided in the first game do not trigger a bonus event for application to the second game in g) and ii) further resolving the bonus event applied to the second game if the symbols provided in the first game do trigger a bonus event for application to the second game in g).

18. The method of claim 17 wherein the display system for individual and collective symbol output is selected from the group consisting of v) a physical reel system providing the first and second distinct display segments controlled by the first processor, vi) a single video display system providing the first and second distinct display segments controlled by the first processor and a combination of a physical reel system and vii) a video display system providing the first and second distinct display segments controlled by the first processor, the first processor providing image data from memory to the single video display system to provide symbols that are displayed on the single video display system; and the memory storing an event result tables or paytables having a plurality of outcomes for the two game segments and the bonus event.

19. A method of playing multiple contemporaneous wagering games on a single wagering apparatus, where the single wagering apparatus comprises a first processor, a single display screen for individual and collective symbol output for the contemporaneous multiple wagering games, and an input system for wagering on the wagering game, wherein the method comprises: a) the first processor recognizing two wager segments to play a single round of the contemporaneous multiple wagering games; b) the processor crediting one wager segment to a first distinct display segment used in the play of a first game and the first processor crediting a second wager segment to a second distinct display segment used in the play of a second game; c) the first processor initiating game play and providing random symbols from a first set of symbols to the first display segment for use in the first game; d) the first processor providing random symbols from a second set of symbols to the second display segment for use in the second game; e) the first processor resolving the first wager segment with respect to the random symbols used in the first game; the second wager segment with respect to the random symbols used in the second game; and both the first and second wagers with respect to a combination of the first set of symbols and the second set of symbols.

20. The method of claim 19 wherein the first display segment and second display segment include a single payline consisting of linear or non-linear symbols and both the first screen segment and the second screen segment comprise at least three distinct symbols.

* * * * *